US008962154B2

(12) United States Patent
Yao et al.

(10) Patent No.: US 8,962,154 B2
(45) Date of Patent: Feb. 24, 2015

(54) WEAR RESISTANT INNER COATING FOR PIPES AND PIPE FITTINGS

(75) Inventors: Matthew Yao, Belleville (CA); Louw DeJong, Maple Ridge (CA); Danie DeWet, Kingston (CA)

(73) Assignee: Kennametal Inc., Latrobe, PA (US)

( * ) Notice: Subject to any disclaimer, the term of this patent is extended or adjusted under 35 U.S.C. 154(b) by 632 days.

(21) Appl. No.: 13/162,763

(22) Filed: Jun. 17, 2011

(65) Prior Publication Data

US 2012/0318399 A1 Dec. 20, 2012

(51) Int. Cl.

| | |
|---|---|
| ***B32B 15/00*** | (2006.01) |
| ***C22C 19/07*** | (2006.01) |
| ***B22F 3/10*** | (2006.01) |
| ***F16L 9/14*** | (2006.01) |
| ***B22F 7/08*** | (2006.01) |
| ***C22C 32/00*** | (2006.01) |
| *B22F 5/10* | (2006.01) |

(52) U.S. Cl.

CPC . *C22C 19/07* (2013.01); *B22F 7/08* (2013.01); *C22C 32/0052* (2013.01); *B22F 5/106* (2013.01); *B22F 2999/00* (2013.01)

USPC ..... 428/668; 138/145; 427/236; 427/239; 427/181; 427/191; 427/383.7; 420/436

(58) Field of Classification Search

CPC ..... C22C 32/0047; C22C 32/0052; C22C 32/0073; B22F 7/08; B22F 7/047; B22F 5/106

USPC ..... 428/668; 427/236, 239, 181, 189–191, 427/383.7, 422; 420/435–436; 138/145

See application file for complete search history.

(56) References Cited

U.S. PATENT DOCUMENTS

| | | | |
|---|---|---|---|
| 3,257,178 | A | 4/1963 | Severns, Jr. et al. |
| 3,410,732 | A | 11/1968 | Smith |
| 3,676,085 | A | 2/1971 | Evans et al. |
| 3,720,537 | A | 3/1973 | Rigney |
| 4,389,439 | A | 6/1983 | Clark et al. |

(Continued)

FOREIGN PATENT DOCUMENTS

| | | | | |
|---|---|---|---|---|
| CA | 1235026 | * | 4/1988 | ..... B22F 3/02 |
| JP | 7300642 | | 11/1995 | |
| JP | 2010-261056 | * | 11/2010 | ..... C22C 19/07 |
| WO | 2009146381 | | 12/2009 | |

OTHER PUBLICATIONS

Radkevych et al. ("Damage to the Metal of Industrial Pipelines in a Hydrogen Sulfide Environment" Mats. Sci. vol. 39, No. 4, 2003).*

(Continued)

*Primary Examiner* — Humera Sheikh
*Assistant Examiner* — Lucas Wang
(74) *Attorney, Agent, or Firm* — Matthew W. Smith, Esq.

(57) ABSTRACT

A pipe or pipe fitting for use in harsh environment such as in petroleum refinery processes for cracking petroleum feed-stocks, the pipe or pipe fitting comprising a 0.25 to 2.5 mm thick Co-based metallic coating on an internal surface of the pipe body, the coating having a hypereutectic microstructure characterized by carbides in a cobalt matrix and an average carbide grain size of less than 50 microns, and the Co-based metallic composition overlays the pipe internal surface at an interface which is free of heat-affected zone and which has a diffusion zone which is less than 0.002 inches thick.

10 Claims, 9 Drawing Sheets

(56) References Cited

U.S. PATENT DOCUMENTS

| | | | | |
|---|---|---|---|---|
| 4,421,717 | A | 12/1983 | Rao | |
| 4,641,864 | A | 2/1987 | Heine et al. | |
| 5,873,951 | A | 2/1999 | Wynns et al. | |
| 6,066,191 | A | 5/2000 | Tanaka et al. | |
| 6,117,493 | A | 9/2000 | North | |
| 6,187,147 | B1 | 2/2001 | Doerksen | |
| 6,413,582 | B1 | 7/2002 | Park et al. | |
| 6,537,388 | B1 | 3/2003 | Wynns et al. | |
| 6,582,126 | B2 | 6/2003 | North | |
| 6,749,894 | B2 | 6/2004 | Subramanian et al. | |
| 7,615,144 | B2 | 11/2009 | Devakottai et al. | |
| 2003/0017358 | A1* | 1/2003 | Fukubayashi | 428/627 |
| 2004/0001966 | A1* | 1/2004 | Subramanian et al. | 428/679 |
| 2005/0152805 | A1 | 7/2005 | Arnold et al. | |
| 2006/0134455 | A1 | 6/2006 | Belhadjhamida et al. | |

OTHER PUBLICATIONS

Kennametal Stellite, "Stellite 1", <http://stellite.com/ProductsServices/HardfacingAlloys/CoredWeldingWire/TubularWire/Stellite1/tabid/152/Default.aspx>, accessed Jul. 12, 2014.*

Davis, "Nickel, Cobalt, and Their Alloys", Dec. 2000, ASM Int'l, pp. 362-364.*

Abstract of JP7300642; Nov. 14, 1995.

European Search Report, European Application No. 12004537.2, dated Oct. 19, 2012, 4 pages.

Wu et al., "Wear Corrosion Resistant Alloys for Oil Drilling and Refineries", Paper No. 05084, Corrosion 2005, 15 pages; 2005.

Raghu et al, "High-Temperature Corrosion and Wear Properties of HVOF Coatings of Cobalt-based (CoCr) Surfacing Alloys", Paper No. 272, Corrosion 99, 21 pages; 1999.

* cited by examiner

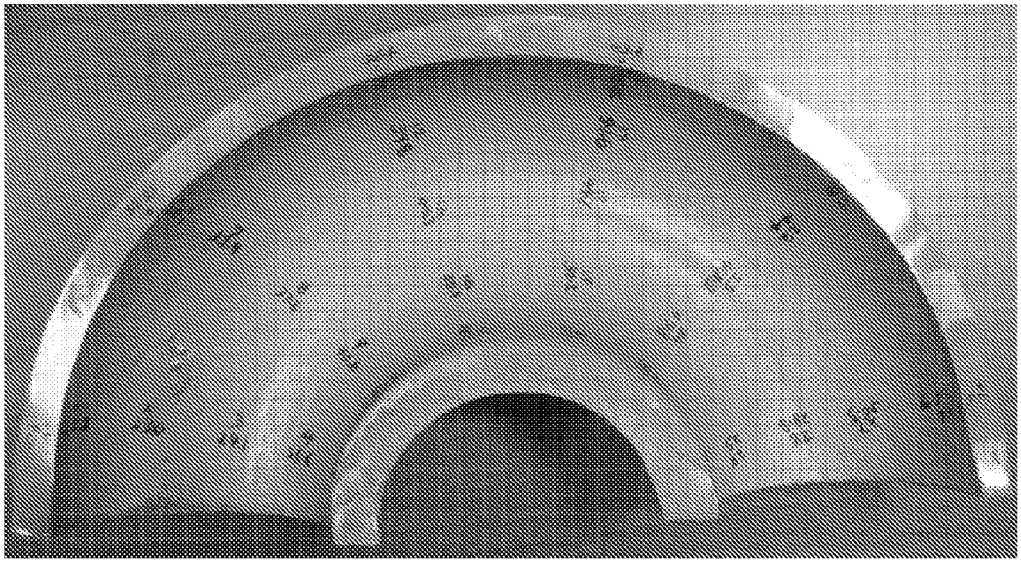
FIG 1
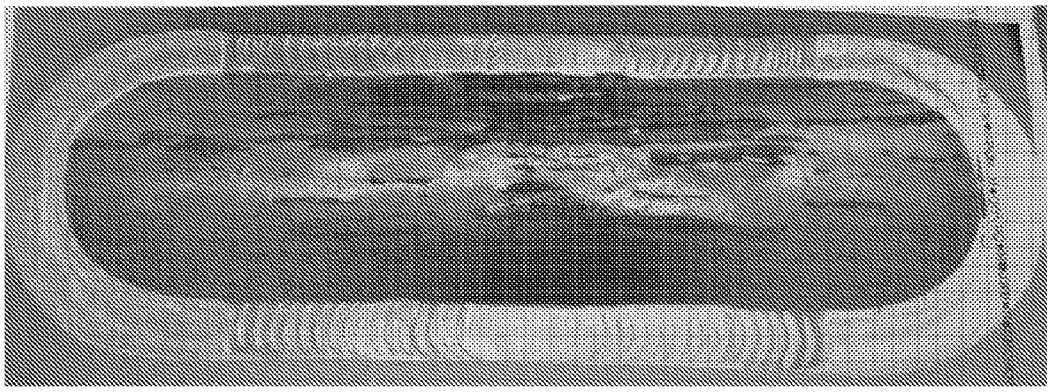
FIG 2 - Prior Art

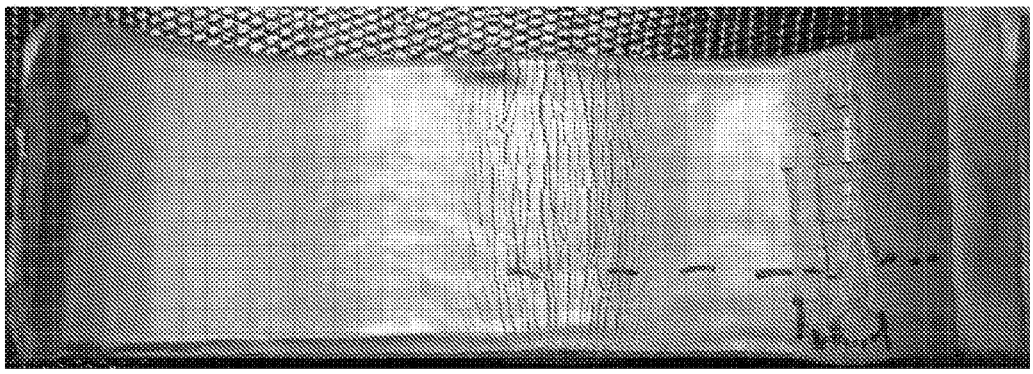
FIG 3
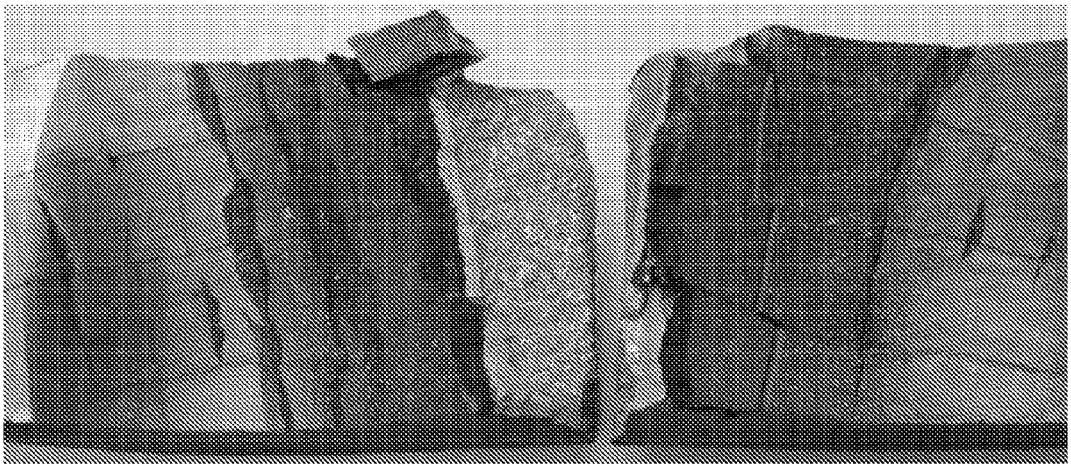
FIG 4 - Prior Art

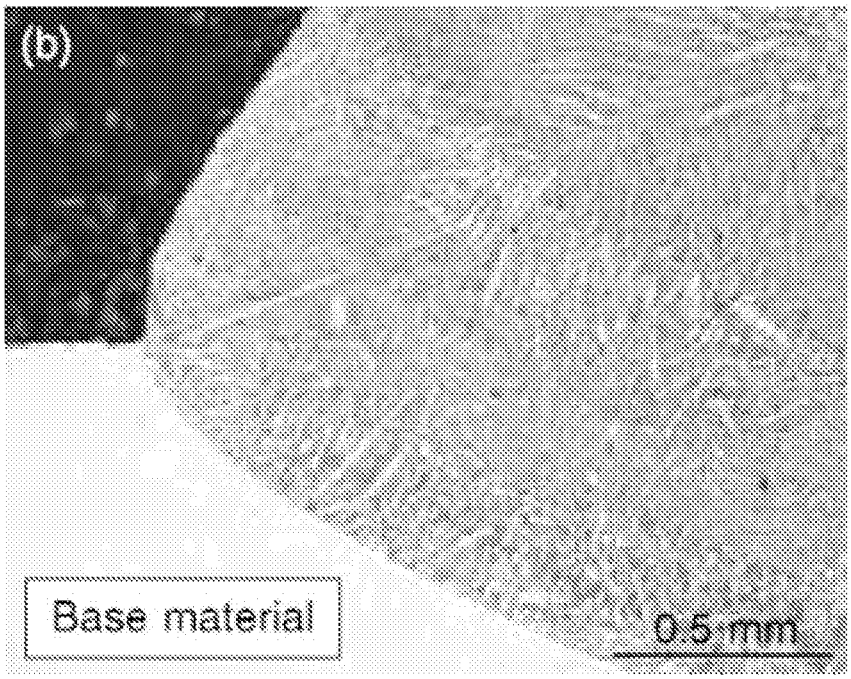
FIG 9 - Prior Art
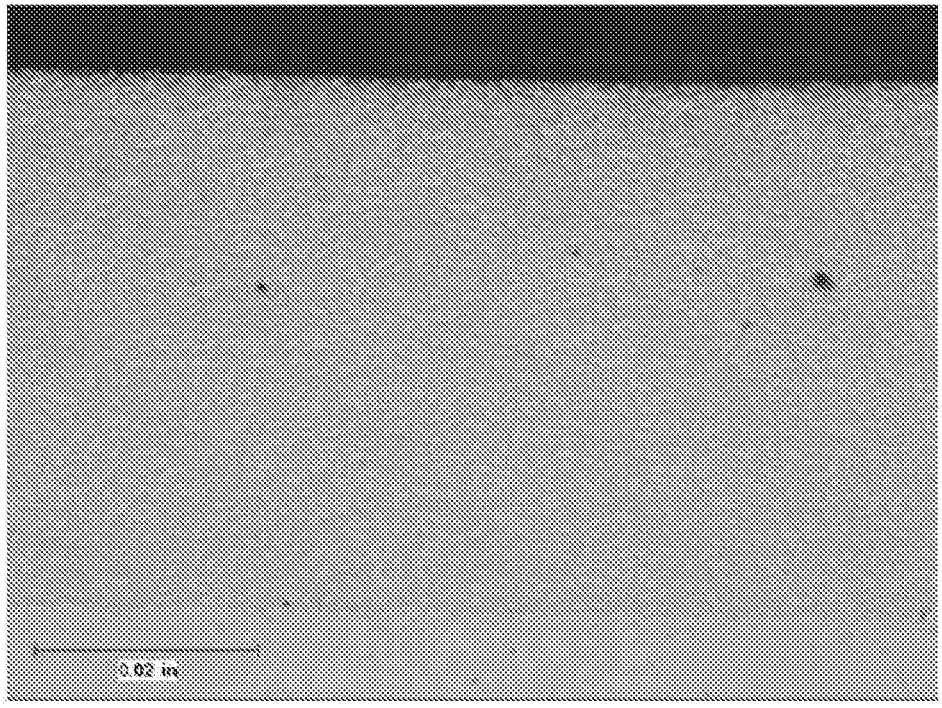
FIG 10

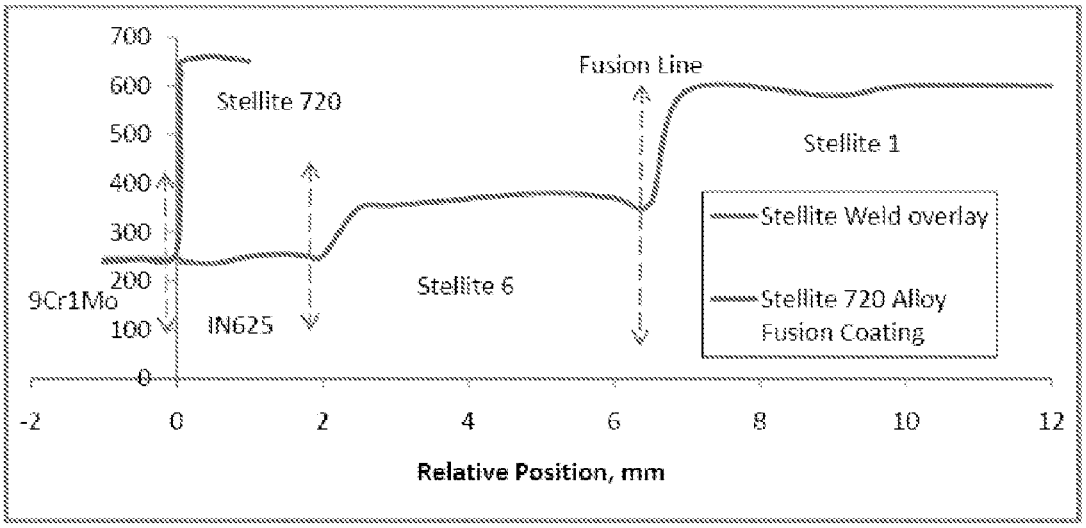
FIG 11
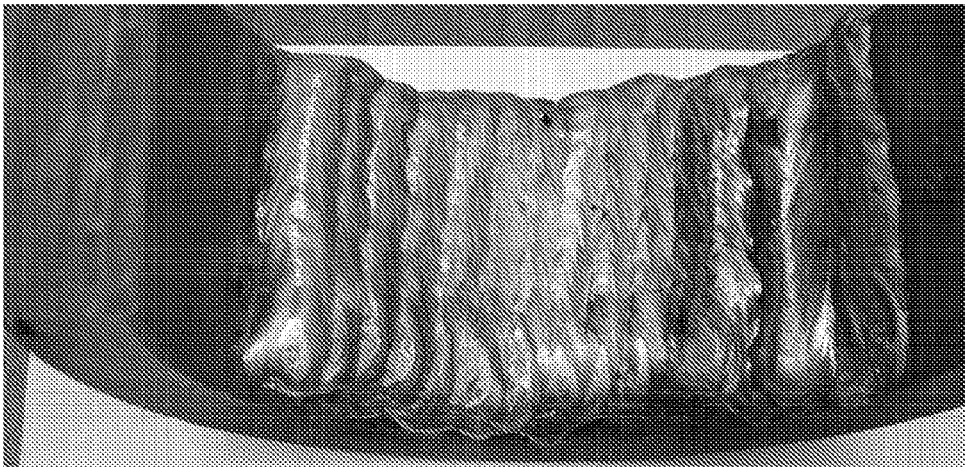
FIG 12 - Prior Art

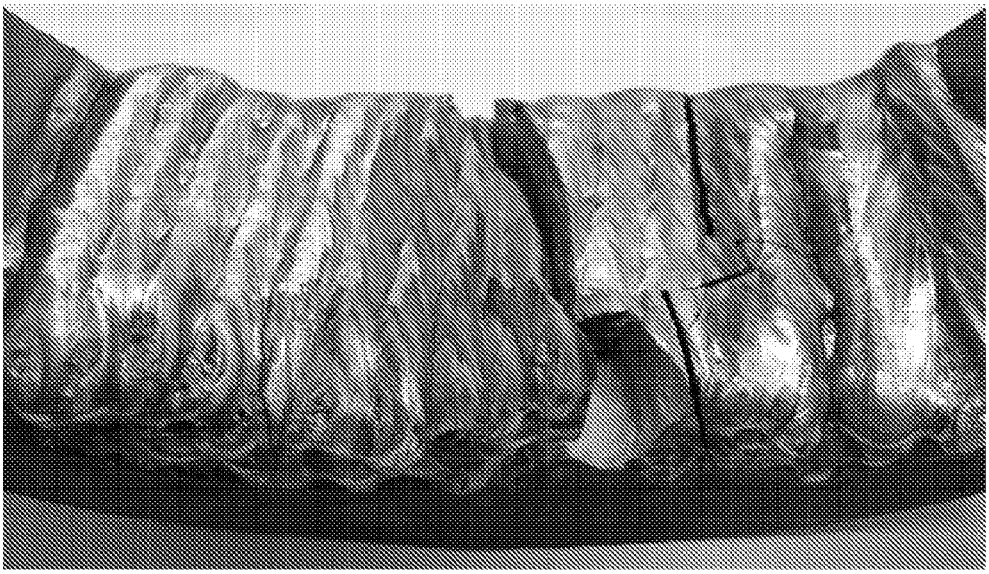
FIG 13 - Prior Art
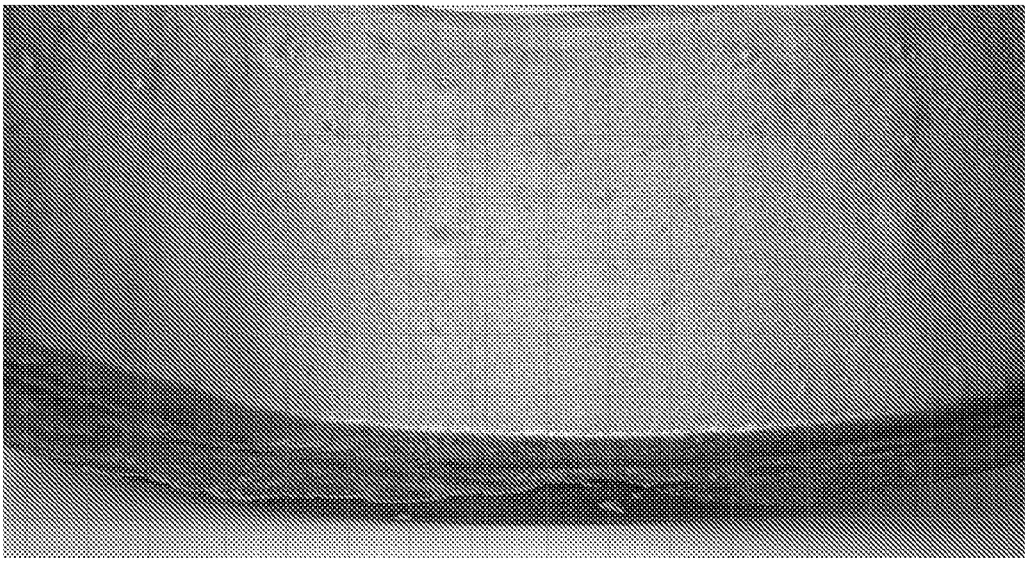
FIG 14

WEAR RESISTANT INNER COATING FOR PIPES AND PIPE FITTINGS

FIELD OF THE INVENTION

This invention is about coatings for the inner surface of pipes and pipe fittings such as pipe elbows and return bends to enhance the wear resistance and manufacturing methods to apply the coatings.

BACKGROUND OF THE INVENTION

Petroleum refinery equipment components experience varying degrees of high temperature erosion and corrosion. Typical components affected include, for examples, piping elbows, nozzles, valve seats and guides, thermowells, and pump internals. Ethylene is produced by cracking petroleum feedstocks, such as ethane and naphtha, at temperatures up to 1150° C. (2100° F.), thus making the process gas stream inside the tube highly carburization. The furnace tubes suffer both carburization and coking on the internal surface of the tube. In order to maintain the process efficiency, the coke deposits have to be regularly removed from the tube inner diameter (ID) surface by a process referred to as "decoking" at approximately 300° C. (550° F.), which involves injecting a mixture of steam and air into the furnace tube. Thus, the high temperature and wear resistant alloy components of radiant furnace coils are often observed to suffer from severe erosion damages caused by impingement of coke particles generated during ethylene cracking process. The most erosive experience is during the internal tube cleaning process called "spalling" at about 700° C. (1300° F.).

Short-term solutions include modifying various process parameters to reduce the extent of coke deposition or increasing the frequency of decoking to minimize wear. Some fitting designs include a heavy outside wall to absorb erosion from coke particles and during decoking. For example, for coker heaters, the last four return bends in the radiant section may have heavier wall thicknesses. However, these designs can suffer thermal fatigue as a result of the cyclic nature of regular operations, decoking, and startup and shutdowns. That is, generally speaking, thicker, non-uniform walled tubes and other components are more prone to thermal fatigue, so this solution has been imperfect.

Longer-term solutions are to apply wear and corrosion protective coatings to the components. However, hard-facing an inner surface of a pipe has proved very difficult because the line of sight is lost. Such weld deposits are also subject to overlay cracking, underbead cracking and cracking into the base material.

Boron, carbon, and nitrogen diffusion coatings have also been promoted to retard coke build up. However, fabrication issues have prevented the coatings from having much success in industry.

High temperature abrasion, erosion and corrosion resistant components in refineries have been in some instances manufactured from Co—Cr—W alloys incorporating a generous amount of Cr and W. They have been castings of these alloys in some instances, and deposition of wear-resistant Co—Cr—W alloys by hard-facing onto steel substrates in other instances. Wrought Co—Cr—W alloys have also been used. These solutions to this long-standing problem has been satisfactory, however, because castings of these alloys are especially expensive and difficult to make, and hard-facing suffers from line-of-sight, heat-affected zone, and other problems.

A number of prior patents illustrate the state of the art in this technical field of imparting wear and abrasion resistance to pipe interiors. For example, U.S. Pat. No. 4,389,439 to Clark et al. discloses an erosion resistant diffusion coating on the surface having an inner layer comprising intimately dispersed iron carbide and an outer layer consisting essentially of iron boride for the tubular apparatus for handling slurries.

U.S. Pat. No. 4,641,864 to Heine et al. discloses an abrasion resistant pipe bend or elbow for slurry pipelines. The bend or elbow has a wall of enlarged thickness includes a plurality of spaced protrusions. Leading edges of the protrusions optionally have a cladding of an abrasion resistant hardfacing composition disposed for example by laser cladding.

U.S. Pat. No. 5,873,951 and No. 6,537,388 to Wynns et al. disclose diffusion coated ethylene furnace tubes. The inner surface of the ethylene furnace tubes is diffusion coated with a sufficient amount of Cr or Cr and Si to form a first coating having a thickness of at least two mils. A second coating of a sufficient amount of Al or Al and Si is diffused onto the first coating to form a total coating thickness of at least five mils.

U.S. Pat. No. 6,187,147 to Doerksen discloses return bend elbow fittings in a delayed coker furnace which are improved by subjecting the inner surface of the fittings to a boron diffusion hardfacing process and forming a hardened layer typically a few thousandths of an inch in thickness.

U.S. Pat. No. 6,413,582 to Dong-Sil Park et al. discloses a method for slurry coating internal surface of a superalloy substrate. The slurry contains a variety of aluminum-containing materials such as aluminum, platinum aluminide, nickel aluminide, platinum-nickel aluminide, refractory-doped aluminides, or alloys which contain one or more of those compounds. The coating is diffusion bonded to the substrate at temperatures from 1800 F to 2100 F. The coating thickness varies from 0.005" to 0.010".

U.S. Pat. No. 6,749,894 to Chinnia G. Subramanian et al. discloses corrosion-resistant thin coatings (0.004-0.400") for steel tubes. The coating methods are PTAW, CVD, thermal spray and also slurry coating followed by reactive sintering at a temperature in the range of 1112 F to 2192 F, preferably in the range of 1742 F to 2102 F. The powders used are crushed and 2 to 10 μm and 50 to 150 μm powders are blended together. Carbon content has to be very low in order to maintain good corrosion resistance. Typical alloy examples are UNS N10276 and UNS N06200. Also silicon is included in the blended powders to lower the melting point during reactive sintering. Some or all of the powder preferably has an angular, irregular or spikey shape. The coating material contains up to 1.0 wt % Y, Zr, Ce and C.

U.S. Pat. No. 7,615,144 to Devakottai et al. discloses a thermal cracking process that employs at least one bend fitting carrying a protective layer comprising a steel carrier and carbide pellets applied by MIG welding or plasma arc welding.

Accordingly, the industry has remained in need of a solution to high temperature erosion and corrosion of pipe interiors, especially at returns and bends.

SUMMARY OF THE INVENTION

Briefly, therefore, the invention is pipe or pipe fitting for a variety of demanding purposes such as a petroleum refinery pipe for use in processes for cracking petroleum feedstocks comprising a pipe body substrate selected from among carbon steels, alloy steels, and stainless steels and a Co-based metallic coating on an internal surface of the pipe body wherein the coating has a thickness between about 0.25 and 2.5 mm thick, wherein the coating has a composition comprising between about 25 and about 35 wt % Cr, between about 11 and about 20 wt % Mo and/or W, between about 2 and about 3.4 wt % C, up to about 1.5 wt % Si, up to about 1 wt % B, and between about 40 and about 55 wt % Co, wherein the coating has a hypereutectic microstructure characterized by carbides in a cobalt matrix and an average carbide grain size of less than 50 microns, and wherein the Co-based metallic composition overlays the pipe internal surface at an interface which is free of heat-affected zone and which has a diffusion zone which is less than 0.002 inches thick.

In another aspect the invention is a method of imparting high-temperature wear and erosion resistance to an internal surface of a pipe or pipe fitting comprising applying a metal slurry comprising metallic powder to an internal surface of a pipe substrate selected from among carbon steels, alloy steels, and stainless steels, and sintering the Co-based metallic composition to form a substantially continuous Co-based alloy coating between about 0.25 and 2.5 mm thick, wherein the metallic powder has an average size less than 45 microns and is pre-alloyed Co-based alloy powder comprising between about 25 and about 35 wt % Cr, between about 11 and about 20 wt % Mo and/or W, between about 2 and about 3.4 wt % C, up to about 1.5 wt % Si, up to about 1 wt % B, and between about 40 and about 55 wt % Co, wherein the sintered continuous Co-based metallic composition has a microstructure characterized by carbides in a cobalt matrix and an average carbide grain size of less than about 50 microns, and wherein the Co-based metallic composition overlays the pipe internal surface at an interface which is free of heat-affected zone and which has a diffusion zone which is less than 0.002 inches thick.

Other objects and features of the invention will be in part apparent and in part pointed out hereinafter.

BRIEF DESCRIPTION OF THE FIGURES

FIG. 1 is a photograph of a return bend according to the invention which includes an alloy coating.

FIG. 2 is a photograph of a pipe segment interior coating applied by welding overlay.

FIG. 3 shows is a photograph of a coating on a substrate during a bending test.

FIG. 4 shows is a photograph of a coating on a substrate during a bending test.

FIG. 9 is a photomicrograph of a welding overlay.

FIG. 10 is a photomicrograph of a metal coating.

FIG. 11 is a graphical hardness profile.

FIG. 12 is a photograph of a weld overlay.

FIG. 13 is a photograph of a weld overlay after a bending test.

FIG. 14 is a photograph of an alloy coating.

DETAILED DESCRIPTION OF PREFERRED EMBODIMENTS

Figure 5:
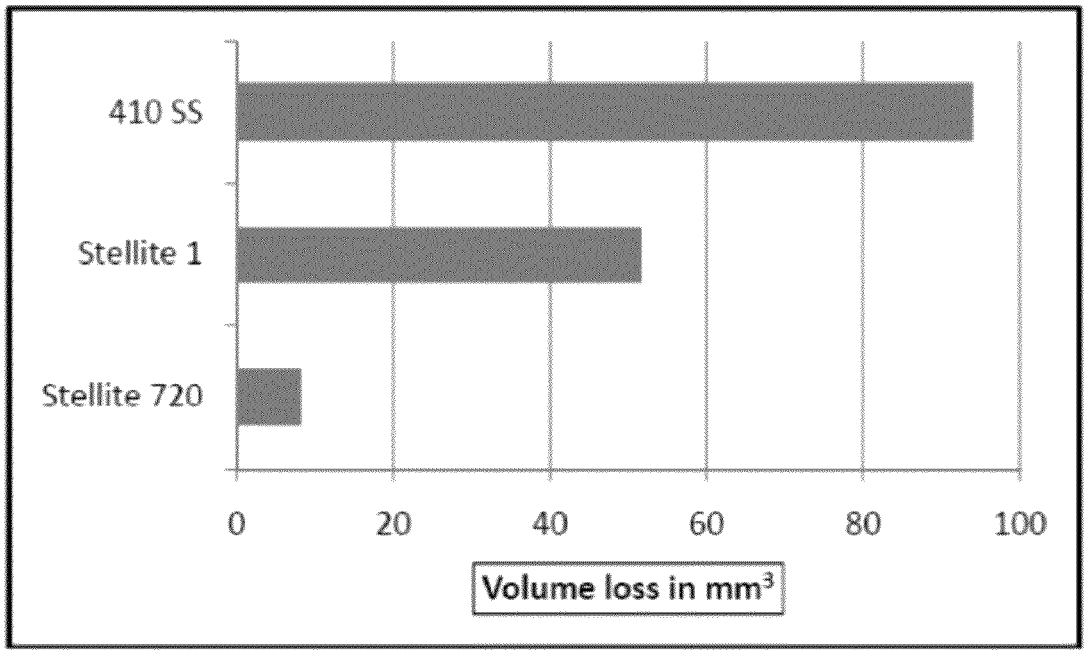
FIG. 5 is a graph of abrasion resistance data.

In order to address the foregoing shortcomings, the inventors have developed a pipe segment component which has a special properties which overcome the problems of the prior art. The pipe segment of the invention in one preferred embodiment is a pipe segment for use in harsh environment such as in petroleum refinery processes for cracking petroleum feedstocks. In certain embodiments the pipe body substrate has a pipe bend of at least 90 degrees.

The pipe segment of the invention is particular advantageous in that it has uniform and predictable base material properties and dimensions, not subject to welding distortion and heat-affected zones. The smooth coating enables ease of in-service ultrasonic thickness monitoring and smart pigging during operation, which involves inspection and maintenance using "smart pigs" which clean pipes and measure characteristics such as pipe thickness, metal loss, corrosion, and rely on a smooth interior surface for operation. There is a significant improvement in-service flexibility over the rigid thick-walled castings. There is improved and predictable wear resistance over weld overlay, which is prone to rough surface conditions and cracking. The thinner coating provides a microstructure preferred over thick welding overlay, which is subject to spalling and dilution. The invention overcomes the limitation of weld overlay of instability to deposit thin layers due to large waviness of the deposits. Uneven and rough weld deposits disrupt, hinder, and interfere with process fluid flow inside the pipe components. If a smooth surface is needed with weld overlay, a thick deposit has to support larger machining allowance. Excess dilution from the substrate on one hand and/or lack of bonding on the other hand which often results in poor coating are overcome.

The pipe segment comprises a pipe body substrate which is made of carbon steel, alloy steel, or stainless steel. For example, in one embodiment the pipe body substrate is a 9Cr-1Mo alloy which is understood in the art to encompass a variety of steels containing on the order of 9 wt % Cr, 1 wt % Mo, balance Fe, with other additives and impurities such as C, Ni, Mn, Cu, Si, P, S, V, Al and combinations thereof cumulatively less than 2 wt %.

The thickness of the coating is preferably between about 0.25 and 5.0 mm thick. In the most preferred embodiments the coating thickness is between about 0.25 and about 2.5 mm, such as between about 0.25 and about 1.0 mm.

In the most preferred embodiments, the pipe body substrate substrate has a pipe bend of at least 90 degrees, such as an elbow or a U-bend, and the Co-based metallic coating on the internal surface encompasses an outer arc of the pipe bend, where fluids and slurries in the pipe most seriously erode and corrode the inner pipe surface.

In order to resist harsh erosion in the chemically and thermally corrosive environments of petroleum refining, the coating composition is a Co-based alloy comprising Cr, plus either W or Mo or a combination thereof, in combination with high carbon content to form wear resistant carbides. Accordingly, the coating material comprises between about 25 and about 35 wt % Cr, between about 11 and about 20 wt % Mo and/or W, between about 2 and about 3.4 wt % C, up to about 1.5 wt % Si, up to about 1 wt % B, and between about 40 and about 55 wt % Co. In one preferred embodiment, the coating composition comprises or more preferably consists essentially of between 31 and 34 wt % Cr, between 16 and 19 wt % Mo, between 2.1 and 2.5 wt % C, between 0.5 and 1.5 wt % Si, up to 1 wt % B, and between 42 and 50 wt % Co. This embodiment contains Mo and no W, and is a boron modified version of an alloy available under the designation Stellite 720. In an alternative preferred embodiment, the coating composition comprises or more preferably consists essentially of between 31 and 34 wt % Cr, between 15 and 20 wt % W, between 2.1 and 2.5 wt % C, up to 1 wt % B, and between 42 and 50 wt % Co, which is a boron-modified version of an alloy available under the designation Stellite 20. In another preferred embodiment, the coating composition comprises or preferably consists essentially of between 28 and 33 wt % Cr, between 11 and 15 wt % W, between 2.1 and 2.5 wt % C, between 0.5 and 1.5 wt % Si, up to 1 wt % B, and between 47 and 55 wt % Co, which is a boron-modified version of alloys available under the designations Stellite 1 and 3.

The coating composition is deliberately selected to provide a hypereutectic microstructure characterized by carbides in a Cr, Mo and/or Mo alloyed cobalt matrix and an average carbide grain size of less than 50 microns. The hypereutectic microstructure is critical to the performance of the coating in the petroleum refining process pipe applications of the invention because the bulk primary carbide together with the alloyed cobalt matrix provide excellent wear resistance to abrasion and erosion.

The alloys of the invention are distinct from traditional cermets, which are carbides bonded with metals or alloys. In traditional cermets, the starting materials are carbide powder (e.g., WC powder) and separate and distinct binder powder (e.g., Co powder). The low melting metallic binder must be melted to bond the coating. There are a few issues with traditional cermets such as the possible poor bond between the carbide and the metallic binder, and the inhomogeneous carbide distribution. In contrast, the present invention employs pre-alloyed particles where the Cr, W, Mo, Co, C, etc. are prealloyed and the particles are homogeneous in chemistry. The carbide and the cobalt matrix are strongly and intimately bound together with metallurgical integrity.

The Co-based metallic composition overlays the pipe internal surface at an interface which is free of heat-affected zone and which has a diffusion zone which is less than 0.002 inches thick. This is critical because excessive diffusion from the pipe body into the coating occurs if the diffusion zone is greater than 0.002 inches thick.

In applying the coating to the pipe body surface, it is critical to select a process where the grain size of the ultimate coating can be carefully controlled to less than 50 microns. This rules out the possibility of using processes previously proposed for coating pipe interiors such as hard-facing by welding deposition where substantial residual stress and larger grains are formed which are crack prone. This is an especially delicate situation with hard Co-based alloys containing between about 11 and about 20 wt % Mo and/or W and between about 2 and about 3.4 wt % C which are especially crack prone.

In accordance with the invention, in order to achieve a desired interface between the coating and the substrate which is free of heat-affected zone and which has a diffusion zone which is less than 0.002 inches thick, a powder slurry deposition process is used to apply the coating composition to the steel-based pipe substrate. The slurry process comprises preparing a slurry comprising powdered Co alloy particles suspended in an organic binder and solvent. The inner surface of the pipe body substrate is cleaned in preparation for the coating process. The slurry is then applied to the component part, yielding a steel-based pipe body substrate shape having a slurry which comprises between about 30 and about 60 vol % of Co-based metallic composition, between about 0.5 and about 5 vol % binder, and between about 40 to about 70 vol % solvent on a surface of the component. The slurry is then allowed to dry. After the component part is dry, the component is heated in a vacuum furnace to sinter the Co alloy particles and drive off the carrier.

The slurry comprises fine Co alloy powder. The Co alloy powder has the same composition as the Co alloy compositions discussed above with respect to all constituents except possibly boron. The boron can be present in the alloy particles. The average size of the alloy powder is less than 45 microns to precisely control the ultimate grain size to less than 50 microns. The powder has a generally spherical morphology, and other shapes such as angular, irregular, or spikey shapes are avoided.

The organic binder is a substance such as methyl cellulose that is capable of temporarily binding the Co alloy particles until they are sintered. The solvent is a fluid (e.g., water or alcohol) capable of dissolving the organic binder and in which the alloy particles will remain in suspension. The range of these major components of the slurry is as follows:

Alloy powder: about 30 to about 60 vol %

Binder: about 0.5 to about 5 vol %

Solvent: about 40 to about 70 vol %

In one particular embodiment these constituents are present as follows:

Alloy powder: about 41 vol %

Binder: about 0.75 vol %

Solvent: about 58.25 vol %

The slurry is prepared by mixing the powdered alloy particles, binder, and solvent (e.g., by agitation in a paint mixer). After mixing, the slurry is allowed to rest to remove air bubbles. The time required to remove the air bubbles will vary depending on the number of air bubbles introduced during mixing, which depends to a large extent on the method or apparatus used to mix the slurry. A metal part can be dipped in and removed from the slurry as a simple test of the amount of air bubbles in the slurry. If the slurry adheres to the part in a smooth coat, removal of air bubbles is sufficient.

The pipe body substrate to be coated needs to be clean and smooth. The steps taken to clean and smooth the metal body (if any are needed) will vary, depending on the metallurgical processes used to produce the metal body. Generally solvents and the like are used to remove any dirt and grease from the surfaces to be coated. If the inner pipe surface is not sufficiently smooth, the metal body may need to be polished or otherwise smoothed. The pipe body substrate is ready for being coated once the inner surface is clean and smooth enough that the coating will be smooth when it adheres to the inner surface.

Application of the slurry to the metal body is preferably achieved by flowing the slurry into the pipe body interior. The viscosity of the slurry can be adjusted to suit the method of application by controlling the proportion of solvent in the slurry. Once the slurry is applied to the pipe body substrate interior surface, it is allowed to dry (e.g., air dry) until the solvent has substantially evaporated.

After the solvent has evaporated, the component is placed in a furnace to sinter the Co powder particles and drive off the organic binder. This prevents excessive diffusion from the pipe body into the coating, which could lower the wear resistance of the component. The atmosphere in the furnace is preferably a non-oxidizing atmosphere (e.g., inert gas or a vacuum). The sintering temperature is precisely selected so the Co-based coating material on the pipe body substrate interior during sintering exceeds the solidus but never exceeds the liquidus of the coating material. This is critical to minimizing flow while still achieving secure metallurgical bond between the coating and the pipe body interior surface. Only between about 30 and about 50 wt % of the coating material melts under these conditions.

For the general class of alloys described herein where the coating material comprises between about 25 and about 35 wt % Cr, between about 11 and about 20 wt % Mo and/or W, between about 2 and about 3.4 wt % C, up to about 1.5 wt % Si, up to about 1 wt % B, and between about 40 and about 55 wt % Co, the sintering parameters are a temperature between 2050 F and 2300 F for a time between 0.25 hour and 2 hours; for example, between 2100 F and 2250 F for between 0.5 hour and 1 hour In the one preferred embodiment where the coating composition consists essentially of between 31 and 34 wt % Cr, between 16 and 19 wt % Mo, between 2.1 and 2.5 wt % C, between 0.5 and 1.5 wt % Si, up to 1 wt % B, and between 42 and 50 wt % Co, the sintering parameters are a temperature between 2110 F and 2250 F for a time between 0.5 and 1 hour; for example, between 2150 F and 2200 F for between 0.5 and 1 hour. In the other preferred embodiment where the coating composition consists essentially of between 31 and 34 wt % Cr, between 15 and 20 wt % W, between 2.1 and 2.5 wt % C, up to 1 wt % B, and between 42 and 50 wt % Co, the sintering parameters are a temperature between 2100 F and 2250 F for a time between 0.25 and 2 hours; for example, between 2150 and 2220 F for between 0.5 and 1 hour. In the further preferred embodiment where the coating composition consists essentially of between 28 and 33 wt % Cr, between 11 and 15 wt % W, between 2.1 and 2.5 wt % C, between 0.5 and 1.5 wt % Si, up to 1 wt % B, and between 47 and 55 wt % Co, the sintering parameters are a temperature between 2100 F and 2250 F for a time between 0.25 and 2 hours; for example, between 2150 F and 2220 F for between 0.5 and 1 hour.

The following examples further illustrate the invention.

EXAMPLE 1

FIG. 1 shows an interior of a return bend according to the invention which includes a coating of alloy of this nominal composition, by weight %: 32Cr, 18Mo, 1Si, 2.4C, <1W, <1B, and 58.5 Co (Stellite 720). The coating is very smooth, which provides for simple in-service ultrasonic thickness monitoring and smart pigging during operation. For comparison, FIG. 2 shows a pipe segment interior coating of alloy Stellite 1 applied by the traditional welding overlay method of applying wear and erosion resistant coatings to petroleum refinery pipes. The surface is especially uneven. Substantial overcoating is therefore required to provide tolerance for machining back to a smooth surface if a smooth surface is desired for its preferred flow characteristics. The substrate in both samples is 9Cr-1Mo steel.

EXAMPLE 2

FIG. 3 shows a bending test performed on a sample of Stellite 720 on 9Mo-1Cr steel prepared according to the invention. There are many tiny cracks around the severely bent area but no missing pieces of coating material. The bond strength between the alloy coating and the 9Cr-1Mo substrate is very strong. FIG. 4 depicts the same bending test for alloy Stellite 1 applied by welding overlay to a 9Cr-1Mo steel substrate. The sample broke. The cracks are wide open and weld overlay pieces and bits separated from the substrate. The bond strength between the Stellite 1 and the 9Cr-1Mo is low.

EXAMPLE 3

Tests were performed according to ASTM G65 to compare the wear resistance of the Stellite 720 alloy on a 9Cr-1Mo substrate according to the invention to that of Stellite 1 on the same substrate applied by gas tungsten arc welding overlay. The data in FIG. 5 show the invention has exceptional abrasion resistance over Stellite 1 applied by welding overlay and 410 stainless steel. The invention has high and predictable abrasion resistance, in contrast to overlays where the process and alloy dependency introduces unpredictability. The volume loss for GTA Stellite 1 weld overlay is 51.7 $mm^3$ and that of the invention is six times more wear resistant at 8.4 $mm^3$.

EXAMPLE 4

Figure 6:
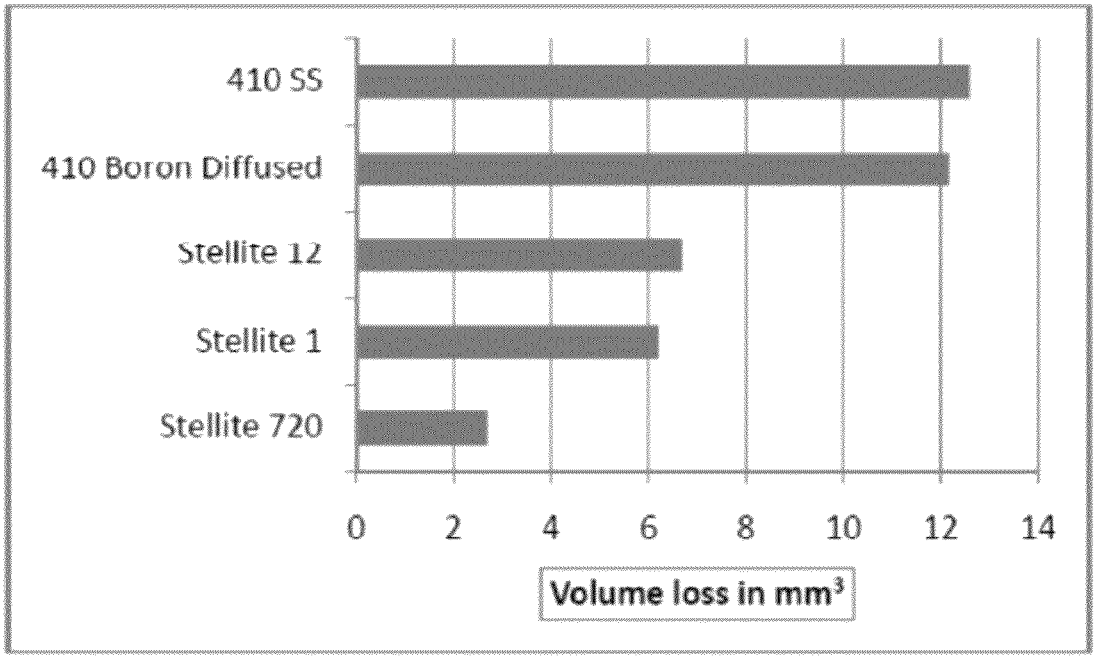
FIG. 6 is a graph of erosive wear test data.

Stellite alloys are noted for their high temperature erosion resistance in a multitude of industries. In petroleum refining, the reactor and regenerator sections of the FCCUs pose severe erosion problems. An accelerated wear test at regenerator temperatures (700° C.), using an FCCU catalyst as the erosive media was conducted according to ASTM G76, and the results presented in FIG. 6. Test conditions: Temperature: 700° C., Erodent: FCCU Catalyst, Impingement Angle: 60°, Velocity: 100 m/s, Particle Flux: 300 g/min, Test Duration: 5 min. 700° C., which also represents the ethylene tubes spalling cleaning temperature. Cobalt based alloys such as Stellite 720, Stellite 1 and Stellite 12 showed a significant engineering advantage over 410, and boron diffused 410. The invention provides an exceptional blend of high temperature erosion, sulfidation, oxidation, and erosion resistance. The high erosion resistance of the invention is a marked advantage over weld overlay Stellite 1 under internal tube "spalling" cleaning condition at about 700° C.

EXAMPLE 5

Figure 7:
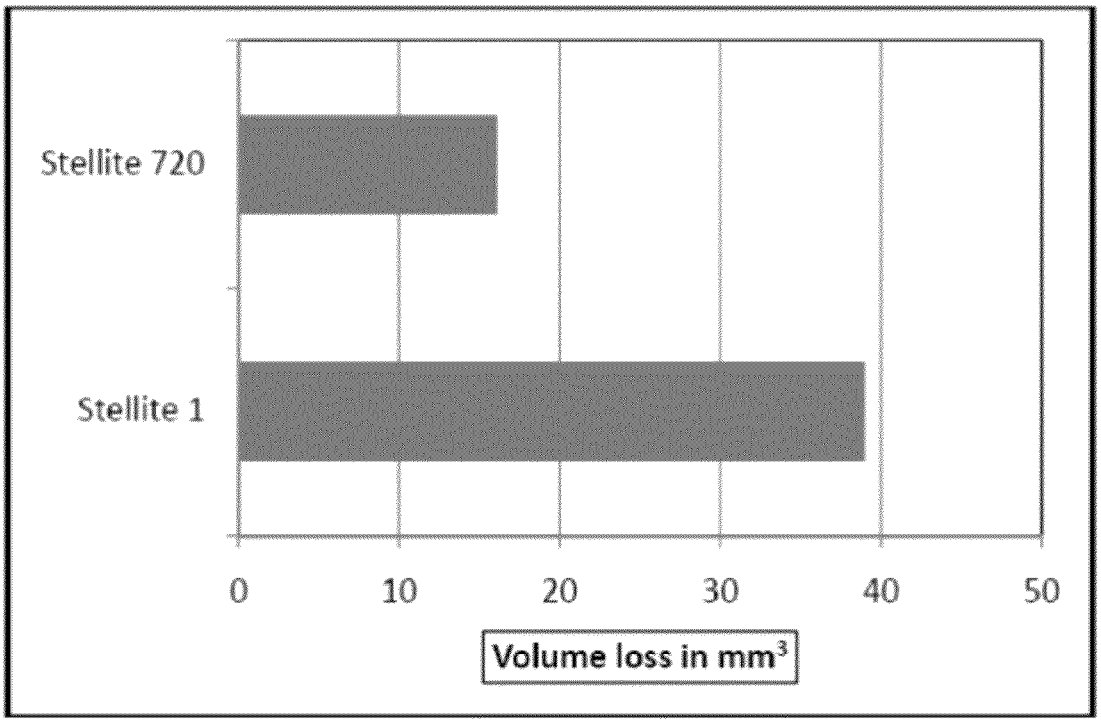
FIG. 7 is a graph of erosive wear test data.

An accelerated wear test under ASTM G76 at temperature (300° C.) was also conducted to compare the erosion resistance of overlay Stellite 1 and the current invention of Stellite 720 by fusion coating, and the results presented in FIG. 7. Test conditions are: Temperature: 300° C., Erodent: $SiO_2$ sand, Impingement Angle: 30°, Velocity: 50 m/s, Particle Flux: 50 g/min, Test Duration: 30 min. 300° C. is the temperature at which the steam decoking of ethylene tubes usually takes place. The combination of the invention provides exceptional high temperature erosion at 300° C. The high erosion resistance of alloy fusion Stellite 720 is much better than weld overlay Stellite 1 under internal tube "decoking" cleaning condition at about 300° C.

EXAMPLE 6

Figure 8:
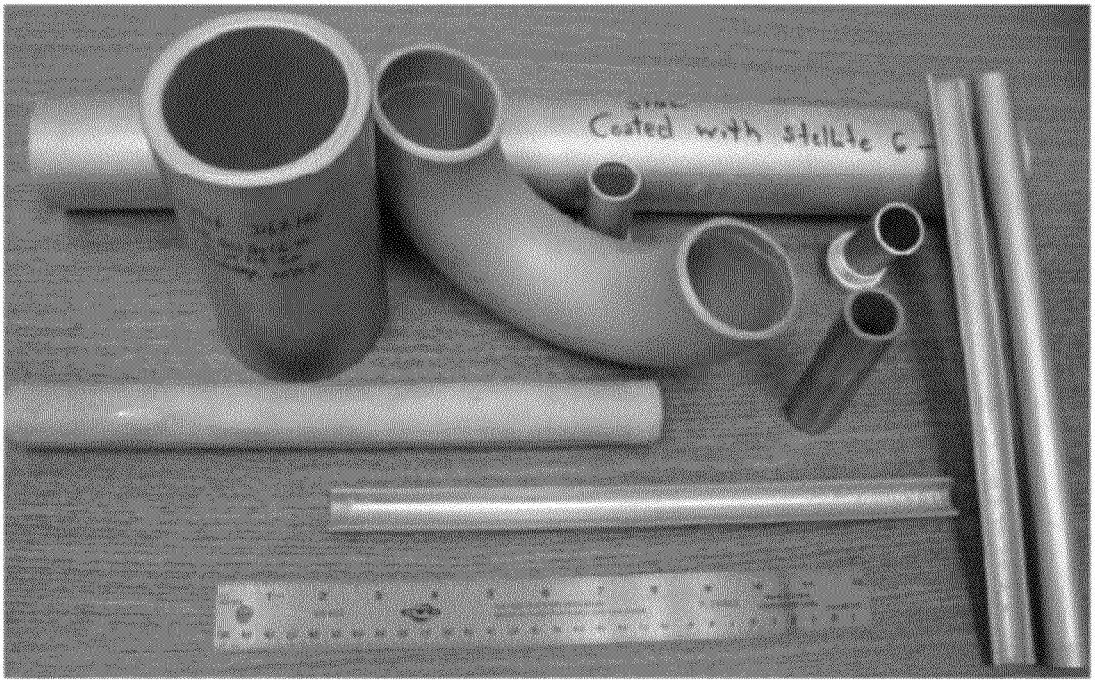
FIG. 8 is a photograph of a variety of pipes prepared according to the invention.

A variety of different diameter pipes and fittings were prepared according to the invention and are shown in FIG. 8.

EXAMPLE 7

FIG. 9 shows a heat-affected zone resulting from welding overlay of Stellite 1 on 9Cr-1Mo steel by metal inert gas deposition. FIG. 10 demonstrates that the Stellite 720 coating over a 9Cr-1Mo steel substrate combination of the invention has a very uniform thickness, no heat-affected zone, and diffusion zone of less than one-thousandth of an inch.

EXAMPLE 8

The hardness profile shown in FIG. 11 reveals that weld overlay Stellite 1 needs buffering layers at least several mm thick in order to achieve its hardness potential. This is due to dilution of the Stellite 1 by softer material diffusing into the coating from the substrate. Accordingly, a very thick coating is necessary to maintain high hardness of Stellite 1 weld overlay. On the other hand, due to the very small diffusion layer between alloy fusion Stellite 720 and the substrate for components prepared in accordance with the invention, a buffering layer is not required and the high hardness of Stellite 720 can be achieved in substantially thinner coating.

EXAMPLE 9

Figure 15:
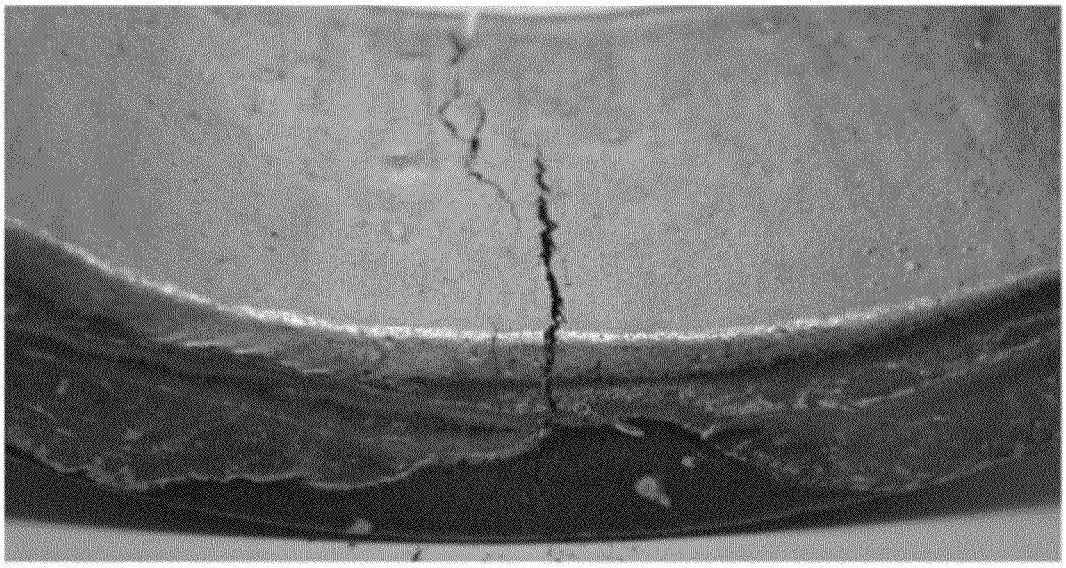
FIG. 15 is a photograph of an alloy coating after a bending test.

FIG. 12 shows a weld overlay of Stellite 3 having a nominal composition, by weight % of 30Cr, 12.5W, <1Mo, 1Si, 2.3C, <1B, and 52.2Co. Cracks can be seen in the as-deposited alloy. FIG. 13 shows the same alloy deposit after a bending test, with large open cracks and spall off. FIG. 14 shows the same alloy deposited by the method of the invention, with a smooth, crack-free surface. FIG. 15 shows this after a bending test, with only very small cracks and no spalling off.

EXAMPLE 10

Figure 16:
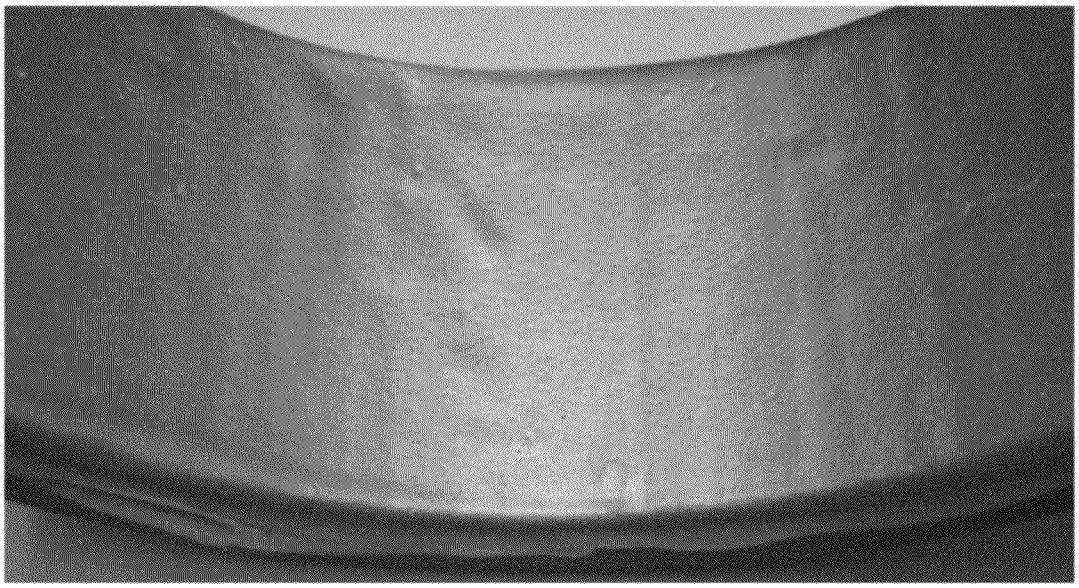
FIG. 16 is a photograph of an alloy coating.
Figure 17:
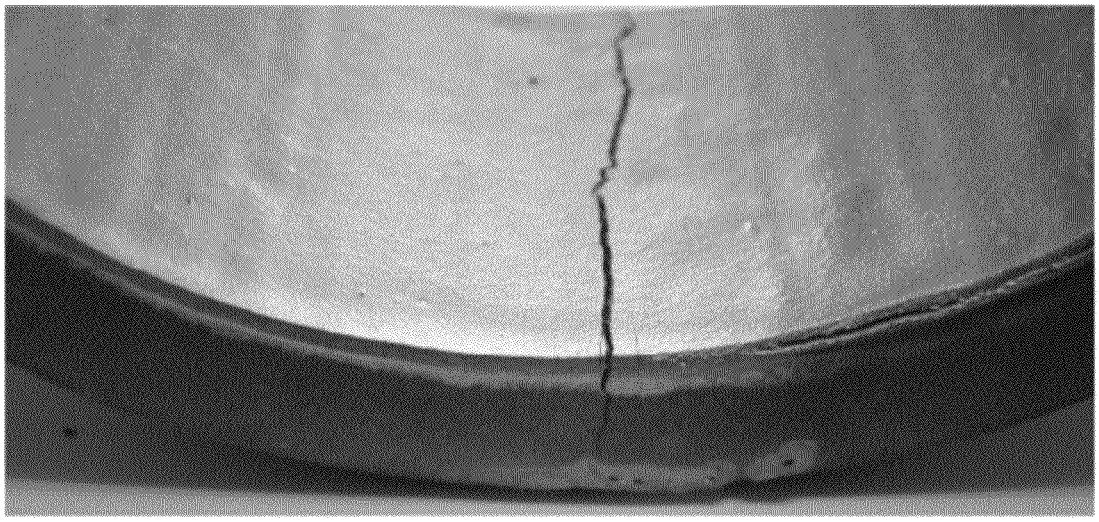
FIG. 17 is a photograph of an alloy coating after a bending test.

FIG. 16 shows alloy Stellite 20 having a nominal composition, by weight % of 32Cr, 18W, <1Mo, 1Si, 2.4C, <1B, and 44.6Co applied by the method of the invention, with a smooth, crack-free surface. FIG. 17 shows this after a bending test, with only one very small cracks and no spalling off.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that several advantages of the invention are achieved and other advantageous results attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

The invention claimed is:

1. A petroleum refinery pipe for use in processes for cracking petroleum feedstocks comprising:

a pipe body substrate selected from among carbon steels, alloy steels, and stainless steels; and a Co-based metallic coating on an internal surface of the pipe body wherein the coating has a thickness between about 0.25 and 2.5 mm thick;

wherein the coating composition comprises between 31 and 34 wt % Cr, between 16 and 19 wt % Mo, between 2.1 and 2.5 wt % C, between 0.5 and 1.5 wt % Si, up to 1 wt % B, and between 42 and 50 wt % Co;

wherein the coating has a hypereutectic microstructure characterized by carbides in a cobalt matrix and an average carbide grain size of less than 50 microns;

wherein the Co-based metallic composition overlays the pipe internal surface at an interface which is free of heat-affected zone and which has a diffusion zone which is less than 0.002 inches thick.

2. A petroleum refinery pipe for use in processes for cracking petroleum feedstocks comprising:

a pipe body substrate selected from among carbon steels, alloy steels, and stainless steels, wherein the pipe body substrate has a pipe bend of at least 90 degrees; and a Co-based metallic coating on the internal surface wherein said coating encompasses an outer arc of the at least 90-degree pipe bend, wherein the coating has a thickness between about 0.25 and 2.5 mm thick;

wherein the coating composition comprises between 31 and 34 wt % Cr, between 16 and 19 wt % Mo, between 2.1 and 2.5 wt % C, between 0.5 and 1.5 wt % Si, up to 1wt % B, and between 42 and 50 wt % Co;

wherein the coating has a hypereutectic microstructure characterized by carbides in a cobalt matrix and an average carbide grain size of less than 50 microns;

wherein the Co-based metallic composition overlays the pipe internal surface at the interface which is free of heat-affected zone and which has a diffusion zone which is less than 0.002 inches thick.

3. The petroleum refinery pipe of claim 2 wherein the coating composition consists essentially of between 31 and 34 wt % Cr, between 16 and 19 wt % Mo, between 2.1 and 2.5 wt % C, between 0.5 and 1.5 wt % Si, up to 1 wt % B, and between 42 and 50 wt % Co.

4. The petroleum refinery pipe of claim 2 wherein the at least 90-degree bend is a U-bend.

5. The petroleum refinery pipe of claim 3 wherein the at least 90-degree bend is a U-bend.

6. A method of imparting high-temperature wear and erosion resistance to an internal surface of a pipe comprising:

applying a metal slurry comprising metallic powder to an internal surface of a pipe substrate selected from among carbon steels, alloy steels, and stainless steels;

and sintering the Co-based metallic composition to form a substantially continuous Co-based alloy coating between about 0.25 and 2.5 mm thick;

wherein the metallic powder has an average size less than 45 microns and is pre-alloyed Co-based alloy powder comprising between 31 and 34 wt % Cr, between 16 and 19 wt % Mo, between 2.1 and 2.5 wt % C, between 0.5 and 1.5 wt % Si, up to 1 wt % B, and between 42 and 50 wt % Co;

wherein the sintered continuous Co-based metallic composition has a microstructure characterized by carbides in a cobalt matrix and an average carbide grain size of less than about 50 microns;

wherein the Co-based metallic composition overlays the pipe internal surface at an interface which is free of heat-affected zone and which has a diffusion zone which is less than 0.002 inches thick.

7. The method of claim 6 wherein the pipe has a bend of at least 90 degrees and the coating is formed on a segment of the pipe internal surface which encompasses an outer arc of the bend.

8. The method of claim 7 wherein the pre-alloyed Co-based alloy powder consists essentially of between 31 and 34 wt % Cr, between 16 and 19 wt % Mo, between 2.1 and 2.5 wt % C, between 0.5 and 1.5 wt % Si, B in a concentration up to 1 wt %, and between 42 and 50 wt % Co.

9. The method of claim 7 wherein the at least 90-degree bend is a U-bend.

10. The method of claim 8 wherein the at least 90-degree bend is a U-bend.

* * * * *